US010900713B2

(12) United States Patent
Gong et al.

(10) Patent No.: US 10,900,713 B2
(45) Date of Patent: Jan. 26, 2021

(54) LOW-TEMPERATURE QUICK-FREEZING FREEZE-DRYING SYSTEM

(71) Applicant: TECHNICAL INSTITUTE OF PHYSICS AND CHEMISTRY, CHINESE ACADEMY OF SCIENCES, Beijing (CN)

(72) Inventors: Maoqiong Gong, Beijing (CN); Yanxing Zhao, Beijing (CN); Hao Guo, Beijing (CN); Jun Shen, Beijing (CN); Xueqiang Dong, Beijing (CN)

(73) Assignee: TECHNICAL INSTITUTE OF PHYSICS AND CHEMISTRY, CHINESE ACADEMY OF SCIENCES, Beijing (CN)

( * ) Notice: Subject to any disclaimer, the term of this patent is extended or adjusted under 35 U.S.C. 154(b) by 197 days.

(21) Appl. No.: 16/368,822

(22) Filed: Mar. 28, 2019

(65) Prior Publication Data

US 2019/0226761 A1 Jul. 25, 2019

Related U.S. Application Data

(63) Continuation of application No. PCT/CN2017/108891, filed on Nov. 1, 2017.

(30) Foreign Application Priority Data

Nov. 11, 2016 (CN) ..... 2016 1 0997926

(51) Int. Cl.
*F26B 5/06* (2006.01)
*F25B 25/00* (2006.01)
(Continued)

(52) U.S. Cl.
CPC ..... *F26B 5/06* (2013.01); *F25B 1/00* (2013.01); *F25B 25/005* (2013.01); *F25B 40/02* (2013.01);
(Continued)

(58) Field of Classification Search
CPC .... F25B 1/00; F25B 2339/047; F25B 25/005; F25B 40/02; F25B 40/06; F25B 41/003; F25B 41/04; F26B 5/06
See application file for complete search history.

(56) References Cited

U.S. PATENT DOCUMENTS 3,210,861 A * 10/1965 Eolkin ..... F26B 5/06 34/289
4,353,222 A * 10/1982 Kobayashi ..... A23L 3/44 62/268
(Continued)

FOREIGN PATENT DOCUMENTS

CN 1361400 A 7/2002
CN 2611840 Y 4/2004
(Continued)

*Primary Examiner* — Jorge A Pereiro
*Assistant Examiner* — Logan P Jones
(74) *Attorney, Agent, or Firm* — Hemisphere Law, PLLC; Zhigang Ma

(57) ABSTRACT

A low-temperature quick-freezing freeze-drying system provided by the invention includes: a compressor unit, a first heat exchanger, an air cooler, a second heat exchanger, a throttling element, a third heat exchanger, a circulating fan, a drying chamber, a third valve, a fourth valve and connecting pipelines, and the above elements form a refrigeration circulation loop, a quick freezing/freeze-drying circulation loop, and a desorption drying circulation loop, thereby realizing the low-temperature quick-freezing and freeze-drying of materials. The invention adopts the heat exchangers with a cold storage function, so that the refrigeration capacity of the compressor is stored and used intensively to achieve rapid cooling of the materials.

7 Claims, 4 Drawing Sheets

(51) Int. Cl.

| | |
|---|---|
| ***F25B 40/06*** | (2006.01) |
| ***F25B 1/00*** | (2006.01) |
| ***F25B 40/02*** | (2006.01) |
| ***F25B 41/04*** | (2006.01) |
| ***F25B 41/00*** | (2006.01) |

(52) U.S. Cl.
CPC ..... *F25B 40/06* (2013.01); *F25B 41/003* (2013.01); *F25B 41/04* (2013.01); *F25B 2339/047* (2013.01)

(56) References Cited

U.S. PATENT DOCUMENTS

| | | | | |
|---|---|---|---|---|
| 5,035,065 | A | 7/1991 | Parkinson | |
| 5,743,023 | A | 4/1998 | Fay et al. | |
| 6,327,866 | B1 * | 12/2001 | Novak | C09K 5/042 62/114 |

FOREIGN PATENT DOCUMENTS

| | | | | |
|---|---|---|---|---|
| CN | 101140126 | A | | 3/2008 |
| CN | 102106591 | A | | 6/2011 |
| CN | 102342565 | A | | 2/2012 |
| CN | 202172804 | U | | 3/2012 |
| CN | 104296502 | A | | 1/2015 |
| CN | 104534729 | A | | 4/2015 |
| CN | 105533392 | A | | 5/2016 |
| CN | 106352664 | A | | 1/2017 |
| EP | 3015804 | A | | 9/2016 |
| JP | 2003194459 | A | | 7/2003 |
| JP | 2010054064 | A | * | 3/2010 |
| WO | 2006134417 | A | | 12/2006 |

* cited by examiner

LOW-TEMPERATURE QUICK-FREEZING FREEZE-DRYING SYSTEM

FIELD OF THE DISCLOSURE

The present invention relates to the field of freezing drying technologies, and more particularly to a low-temperature quick-freezing freeze-drying system.

BACKGROUND

Drying is one of the methods to keep materials from spoilage and deterioration. There are various methods for drying, such as conventional sun drying, boiling, baking, and spray drying, which are carried out at the temperature of 0° C. or above. The products obtained by drying are generally shrunk in size and hardened in texture. Some substances are oxidized, and certain volatile components are mostly lost. The heat-sensitive substances such as proteins and vitamins are denatured, and microorganisms lose biological vitality. The dried substances are not easily dissolved in water. Therefore, the dried products have a large difference in properties compared with the products before drying. Superheated steam drying has been applied in some countries in recent years, but it is also not suitable for the heat-sensitive materials since the temperature of a superheated steam dried material usually exceeds 100° C. Although the operation under vacuum conditions will lower the temperature, the cost of the device and operation complexity will be greatly increased.

The vacuum freeze-drying technology is especially suitable for the heat-sensitive substances, and can keep heat-sensitive components of the dried heat-sensitive materials. Especially, the nutritional ingredients of different levels in food, for example vitamin C, can be stored for more than 90%. However, the initial investment of the device is relatively large, and the system has small processing capacity, low production efficiency and high energy consumption. The vacuum freeze-drying is referred to as freeze-drying, and the drying process thereof is mainly divided into two processes. The first drying process is carried out at a low-temperature and under vacuum. In such process, the drying of the materials mainly depends on the sublimation of ice crystals, so that it is also referred to as sublimation drying. The second stage of drying aims to remove some of the bound water existing in products due to the mechanism of adsorption or the like, and is also known as desorption drying. Since the energy of adsorption is very large, sufficient heat must be supplied to desorb the bound water. In the process of sublimation, on one hand, the materials need to be frozen, and on the other hand, the frozen materials need to be heated and dried under vacuum. The energy consumption for maintaining vacuum and heating and drying is very large, and the time consumption is relatively long due to a low heat exchange coefficient. At present, most of the large-scale vacuum freeze-drying devices at home and abroad adopt freezing and drying separation, that is, the freezing is carried out by using a quick-freezing house, and then the quick-frozen materials are moved to a drying chamber for vacuum sublimation drying. Thus, the quick-freezing house must be separately constructed, which increases the freeze-drying cost. In the desorption process, on one hand, in order to avoid the damage to the materials due to an excessive high temperature, a heating temperature which is generally not higher than 50° C. is required. On the other hand, a large amount of energy is required since the adsorption energy of water molecules needs to be overcome.

At present, electric heating or steam heating is generally used, resulting in additional energy consumption of the system.

Patent CN101140126B provides a freeze-drying system using liquid nitrogen refrigeration. Due to the use of liquid nitrogen refrigeration, the required heat needs additional heating during the desorption process, and the source of liquid nitrogen is limited, and inconvenient to apply. Patent CN1987314B provides a vacuum freeze-drying all-in-one machine adopting two-stage compression refrigeration. The cooling source and the heat source of a refrigeration compressor unit are used to cool and heat the materials, which can greatly reduce the total installed power. However, in order to acquire the low temperature, the system uses the two-stage compressor with intermediate cooling, the refrigerant return air cooling capacity cannot be effectively recovered, and the cooling efficiency is limited. Meanwhile, the system only has the freeze-drying process and no desorption process, and the moisture adsorbed in the materials cannot be removed.

SUMMARY

In view of this, in order to overcome the defects and problems of the prior art, the present invention provides a low-temperature quick-freezing freeze-drying system.

In order to realize the above objective, the present invention adopts the following technical solution.

A low-temperature quick-freezing freeze-drying system includes a refrigeration circulation loop, a quick-freezing/freeze-drying circulation loop, and a desorption drying circulation loop. The refrigeration circulation loop includes a compressor unit, a first heat exchanger, an air cooler, a second heat exchanger, a throttling element, a third heat exchanger, and a connecting pipeline, a high pressure refrigerant outlet of the compressor unit is connected to a refrigerant high pressure inlet of the first heat exchanger, a refrigerant high pressure outlet of the first heat exchanger is connected to an inlet of the air cooler, an outlet of the air cooler is connected to a high pressure refrigerant inlet of the second heat exchanger, a high pressure refrigerant outlet of the second heat exchanger is connected to a refrigerant high pressure inlet of the throttling element, a refrigerant low pressure outlet of the throttling element is connected to a refrigerant inlet of the third heat exchanger, a refrigerant outlet of the third heat exchanger is connected to a refrigerant low pressure inlet of the second heat exchanger, and a refrigerant low pressure outlet of the second heat exchanger is connected to a low pressure inlet of the compressor unit, thereby forming the refrigeration circulation loop;

The quick-freezing/freeze-drying circulation loop includes a circulating fan, a drying chamber, a third valve, the third heat exchanger, a fourth valve and a connecting pipeline which are connected in sequence by a pipeline, low-temperature low-moisture content air A1 passes by the circulating fan and then forms air B1, humid air C1 is formed by absorbing material moisture in the air B1 in the drying chamber, the humid air C1 passes by the third valve to form air D1, after gas-solid separation, low-moisture content low-temperature air E1 is formed from the cooling in the third heat exchanger, and passes by the fourth valve (V4) to form the low-temperature low-moisture content air A1, thereby completing the quick-freezing/freeze-drying circulation loop;

The desorption drying circulation loop includes the circulating fan, the drying chamber, a second valve, a fourth heat exchanger, the third heat exchanger, the first heat exchanger, the first valve and a connecting pipeline which are connected in sequence, high-temperature air A2 passes by the circulating fan to form B2, humid air C2 is formed by absorbing bound water in the high-temperature air A2 in the drying chamber, the humid air C2 passes by the second valve, and then completes the gas-water separation from an air state H to an air state I and a cooling process in the fourth heat exchanger to form air D2, then the air D2 passes by the third heat exchanger to form air E2, the air E2 passes by the fourth heat exchanger to form air F, the air F passes by the first heat exchanger to form air G, and the air G passes by the first valve to form the high-temperature air A2, thereby completing the desorption drying circulation loop.

In an embodiment, the low-temperature quick-freezing freeze-drying system further comprises a control unit electrically coupled to the first valve, the second valve, the third valve, and the fourth valve, wherein the control unit It is configured to control opening and closing of the first valve, the second valve, the third valve and the fourth valve.

In an embodiment, the fourth heat exchanger is further connected to a first separator by a pipeline, in the process from the air state H to the air state I, firstly, preliminary cooling is performed in the fourth heat exchanger, and after gas-liquid separation of the first separator, the formed gas phase enters the fourth heat exchanger to be further cooled to the air state I, and the formed liquid phase is discharged by a liquid phase outlet of the first separator.

In an embodiment, the third heat exchanger is further connected to a second separator S by a pipeline, and the air D1 is firstly subjected to gas-solid separation by the second separator, then the formed gas phase enters the third heat exchanger, and is cooled to form the low-moisture content low-temperature air E1, and the formed solid phase water is discharged by a solid phase outlet of the second separator.

In an embodiment, the third heat exchanger further includes a cold storage material, and the cold storage material includes a phase change cold storage material and a non-phase change cold storage material.

In an embodiment, the phase change cold storage material is a solid-liquid phase change material having a phase transition temperature of −60° C. to −100° C., and includes at least one of octamethyl trisiloxane, decamethyltetrasiloxane, dodecamethylpentasiloxane, tetradecylhexasiloxane, n-propylcyclohexane, vinyl toluene, butylbenzene, sec-butylbenzene, o-methylisopropylbenzene, p-cymene, hexyl acetate, butyl valerate, perfluorohexane, 2H-perfluoropentane, 3H-perfluoropentane, or perfluoro-2-methyl-3-pentanone, and the non-phase change material is stainless steel or aluminum.

In an embodiment, an auxiliary heater is further disposed between the third heat exchanger and the fourth heat exchanger.

The technical solution adopted by the present invention has the following beneficial effects.

The low-temperature quick-freezing freeze-drying system provided by the present invention includes: a compressor unit, a first heat exchanger, an air cooler, a second heat exchanger, a throttling element, a third heat exchanger, a circulating fan, a drying chamber, a third valve, a fourth valve and connecting pipelines. The above elements form the refrigeration circulation loop, the quick freezing/freeze-drying circulation loop, and the desorption drying circulation loop, thereby realizing the low-temperature quick-freezing and freeze-drying of materials. The invention adopts the heat exchangers with a cold storage function, so that the refrigeration capacity of the compressor is stored and used intensively to achieve rapid cooling of the materials.

In addition, according to the low-temperature quick-freezing freeze-drying system provided by the present invention, since air forcible circulation is adopted for freeze-drying, the heat exchange coefficient is large and the drying efficiency is high.

Meanwhile, the low-temperature quick-freezing freeze-drying system provided by the present invention is high in integration level, miniaturized in device, simple in process and efficient and energy-saving.

Compressor unit (CU) 110, first heat exchanger (HX1) 120, second heat exchanger (HX2) 130, third heat exchanger (HX3) 140, fourth heat exchanger (HX4) 150, first Valve (V1) 160, second valve (V2) 170, third valve (V3) 180, fourth valve (V4) 190, throttle valve (JT) 210, air cooler (AC) 220, drying chamber (DC) 230, circulating fan (FAN) 240, first separator (SEP1) 250, second separator (SEP2) 260, auxiliary heater (HT) 270.

DETAILED DESCRIPTION OF PREFERRED EMBODIMENTS

In the following, with reference to accompanying drawings of embodiments of the invention, technical solutions in the embodiments of the invention will be clearly and completely described. Apparently, the embodiments of the invention described below only are a part of embodiments of the invention, but not all embodiments. Based on the described embodiments of the invention, all other embodiments obtained by ordinary skill in the art without creative effort belong to the scope of protection of the invention.

All technical and scientific terms used herein have the same meaning as commonly understood by those skilled in the art of the present invention, unless otherwise defined. The terms used in the description of the present invention is merely for the purpose of describing specific embodiments rather than limiting the present invention. The term "and/or" used herein includes any and all combinations of one or more of the associated listed items.

Embodiment 1

Figure 1:
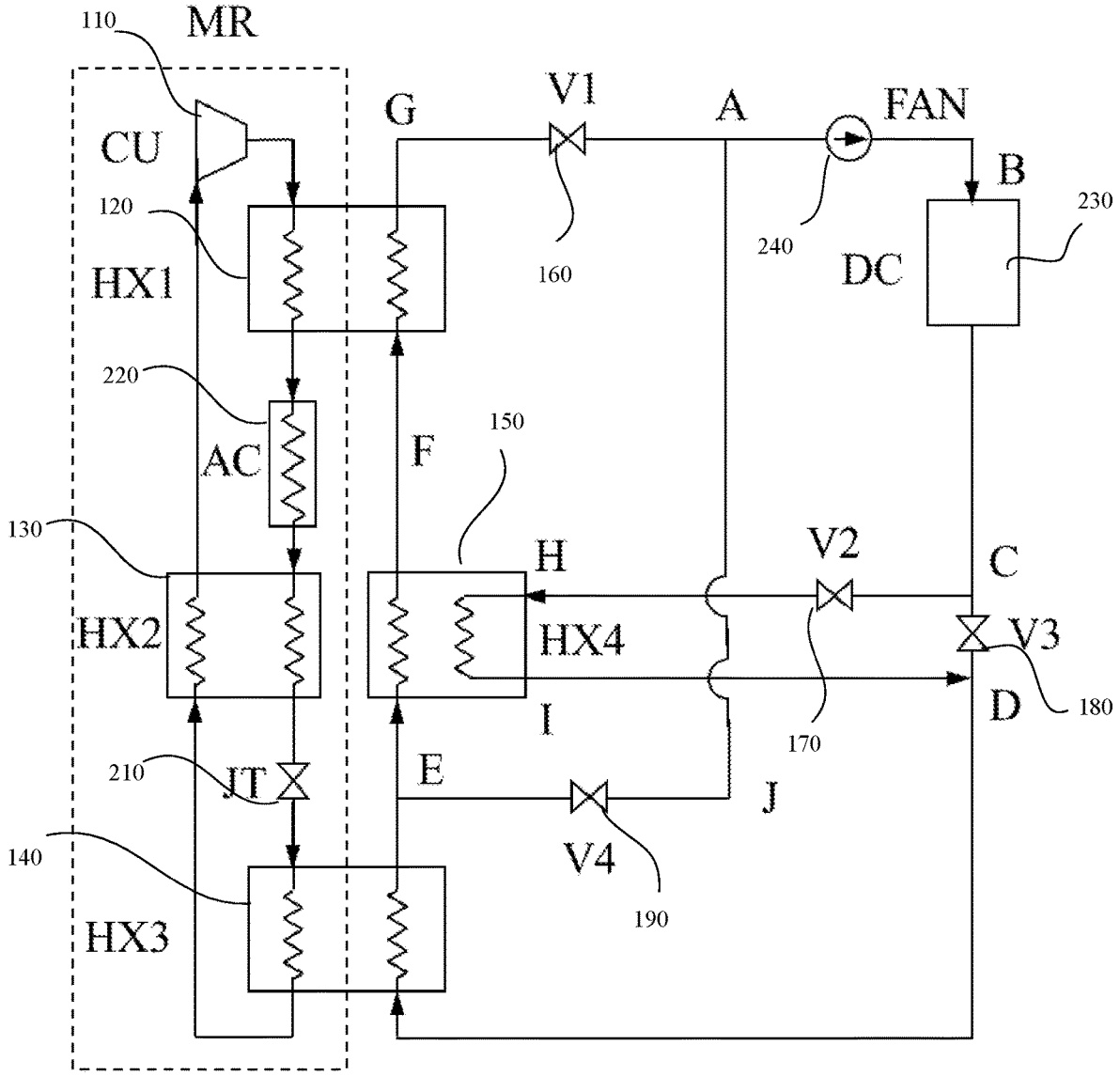
FIG. 1 is a schematic structural view of an ultra-low-temperature quick-freezing freeze-drying system provided by Embodiment 1 of the present invention.

FIG. 1 is a schematic structural view of an ultra-low-temperature quick-freezing freeze-drying system for drying a streptomycin drug provided by Embodiment 1 of the present invention, and the working mode thereof is as follows.

The refrigeration circulation system is turned on, the refrigerant enters the refrigerant high pressure inlet of a first heat exchanger (HX1) 120 at the high pressure refrigerant outlet of a compressor unit (CU) 110. The refrigerant enters the inlet of an air cooler (AC) 220 by the refrigerant high pressure outlet of the first heat exchanger (HX1) 120. The refrigerant enters the high pressure refrigerant inlet connected to a second heat exchanger (HX2) 130 by the air cooler (AC) 220. The refrigerant enters the refrigerant high pressure inlet of a throttling element (JT) 210 by the high pressure refrigerant outlet of the second heat exchanger (HX2) 130. The refrigerant enters the refrigerant inlet of a third heat exchanger (HX3) 140 by the refrigerant low pressure outlet of the throttling element (JT) 210. The refrigerant enters the refrigerant low pressure inlet of the second heat exchanger (HX2) 130 by the refrigerant outlet of the third heat exchanger (HX3) 140. The refrigerant enters the low pressure inlet of the compressor unit (CU) 110 by the refrigerant low pressure outlet of the second heat exchanger (HX2) 130, thereby forming a complete loop. Cold is stored in the third heat exchanger (HX3) 140, and after a cold storage material is cooled to −80° C., the streptomycin drug is placed in the drying chamber DC, and the quick-freezing/freeze-drying circulation loop is turned on.

Embodiment 2

Figure 2:
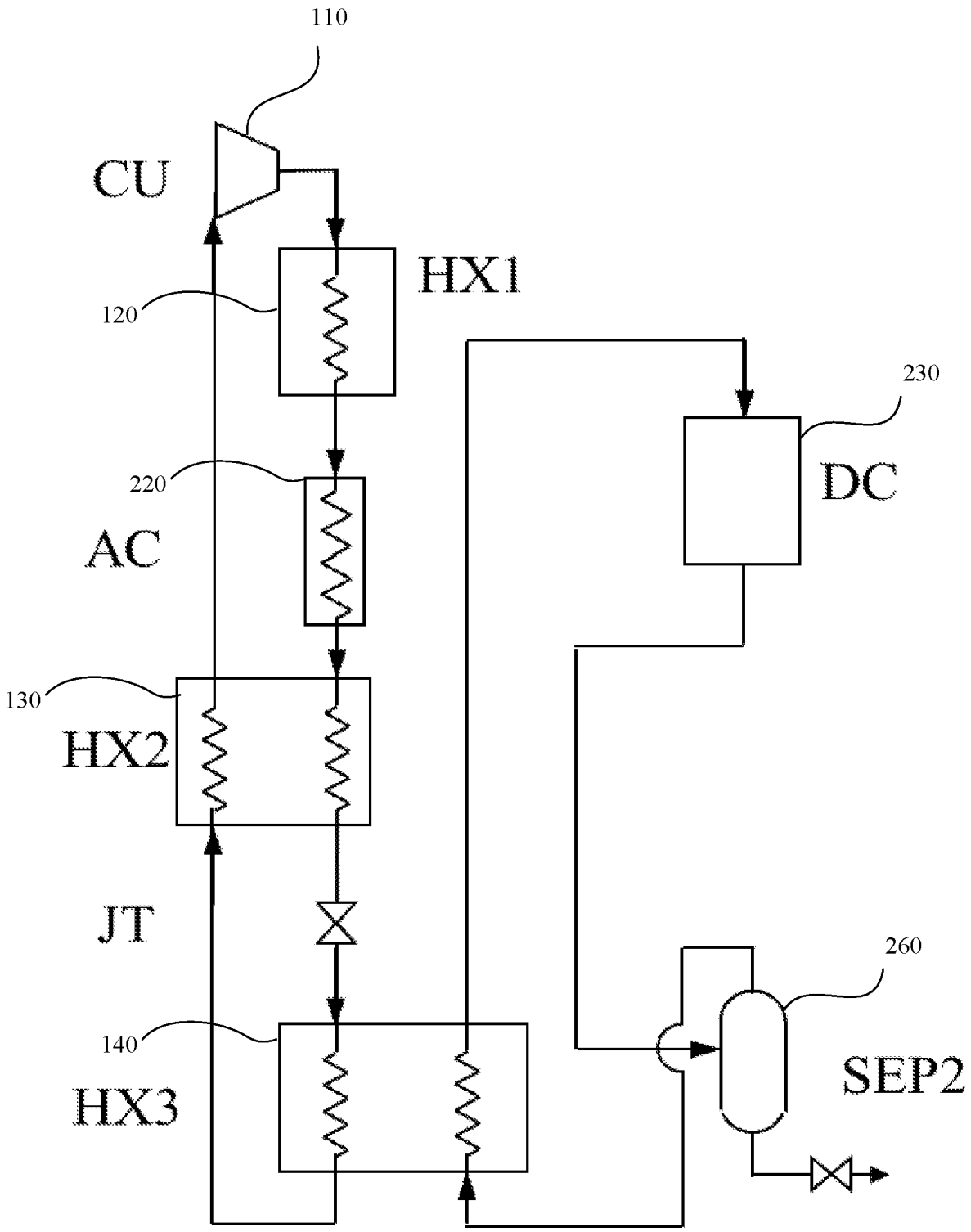
FIG. 2 is a schematic structural view of a quick freezing/freeze-drying working mode provided by Embodiment 2 of the present invention.

FIG. 2 is a quick-freezing/freeze-drying working mode provided by Embodiment 2 of the present invention, and the working mode thereof is as follows.

Low-temperature and low-moisture content air A1 passes by a circulating fan (FAN) 240 to form air B1, humid air C1 is formed by absorbing material moisture in the air B1 in the drying chamber (DC) 230, and the humid air C1 passes by the third valve (V3) 180 to form air D1. After gas-solid separation, low-moisture content low-temperature air E1 is formed from cooling in the third heat exchanger (HX3) 140, and passes by a fourth valve (V4) 190 to form the low-temperature low-moisture content air A1, thereby completing the quick-freezing/freeze-drying circulation loop: A→B→C→D→E→J→A.

It can be understood that since the saturated moisture content of the air at −80° C. is 3.9×10-4 g/kg, most of the moisture can be removed by the quick-freezing/freeze-drying circulation, the remaining adsorbed moisture is removed, and the desorption drying circulation loop is started.

Embodiment 3

Figure 3:
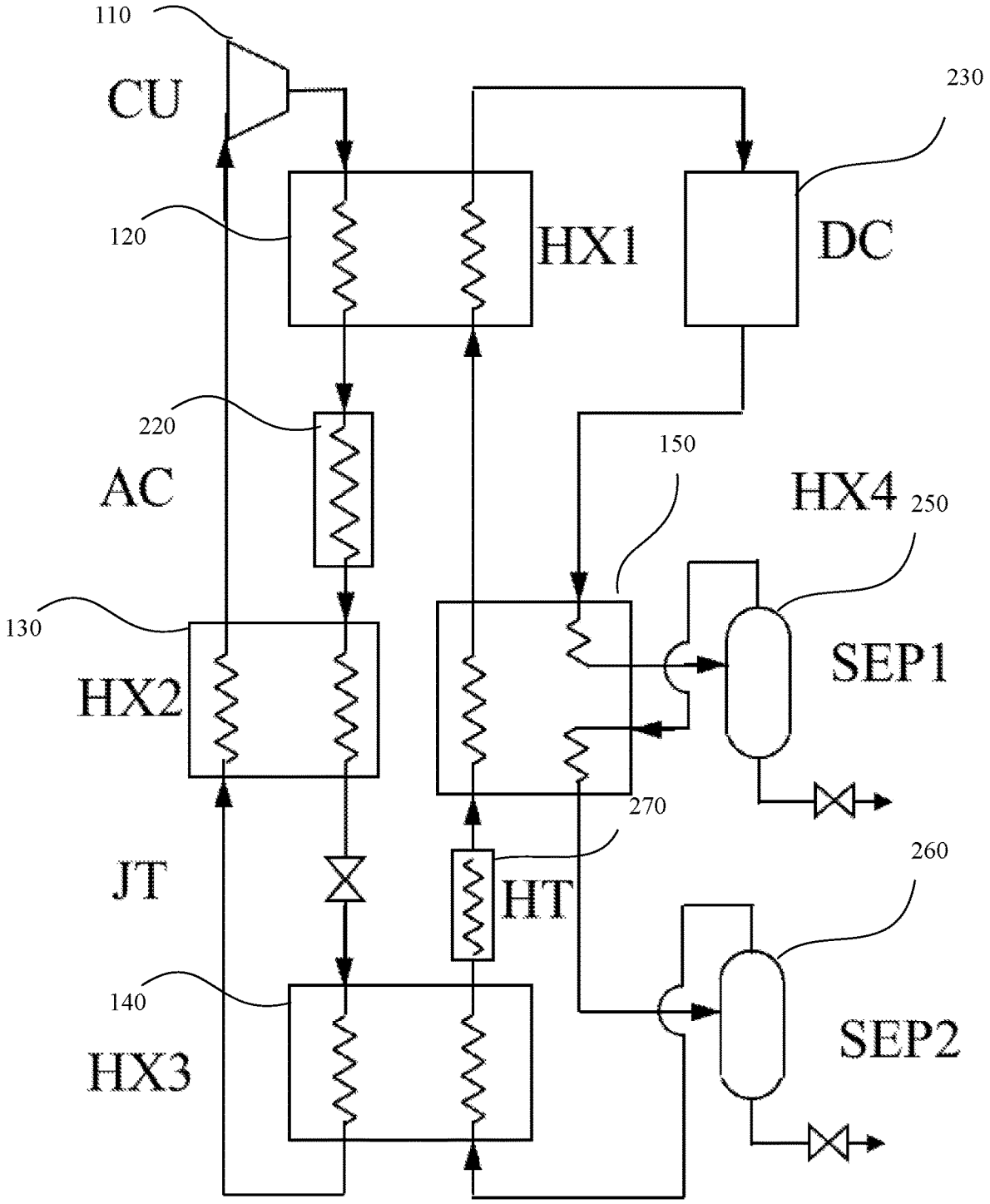
FIG. 3 is a schematic structural view of a desorption drying working mode provided by Embodiment 3 of the present invention.

FIG. 3 is a desorption drying working mode provided by Embodiment 3 of the present invention, and the working mode thereof is as follows.

The air A2 at 40° C. passes by the circulating fan (FAN) 240 to form B2, humid air C2 is formed by absorbing bound water in the high-temperature air A2 in the drying chamber (DC) 230, and the humid air C2 passes by the second valve (V2) 170, and then completes the gas-water separation from an air state H to an air state I and a cooling process in the fourth heat exchanger (HX4) 150 to form air D2. Then the air D2 passes by the third heat exchanger (HX3) 140 to form air E2, the air E2 passes by the fourth heat exchanger (HX4) 150 to form air F, the air F passes by the first heat exchanger (HX1) 120 to form air G, and the air G passes by the first valve (V1) 160 to form the high-temperature air A2, thereby completing the desorption drying circulation loop, A→B→C→H→D→E→F→G→A. The ultra-low-temperature quick-freezing freeze-drying process of the streptomycin drug is completed.

Embodiment 4

Figure 4:
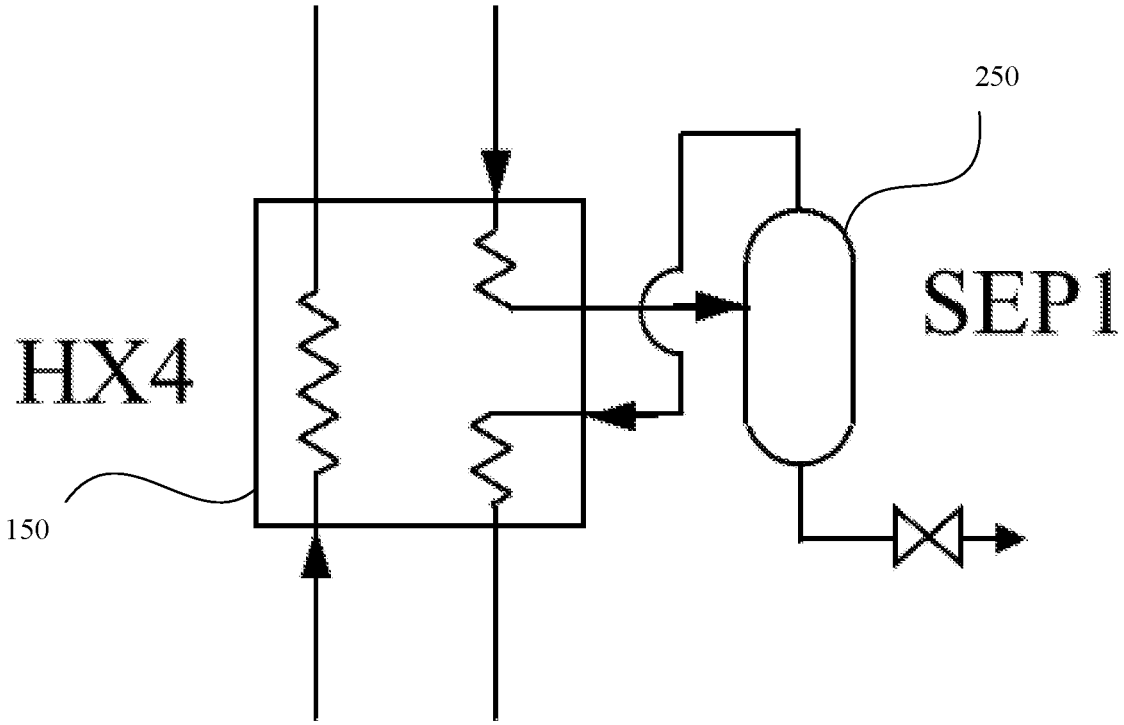
FIG. 4 is a schematic structural view of a fourth heat exchanger HX4 with a first separator SEP1 provided by Embodiment 4 of the present invention.

FIG. 4 is a schematic structural diagram of a fourth heat exchanger HX4 with a first separator SEP1 provided by Embodiment 4 of the present invention.

Preferably, in the process from the air state H to the air state I, firstly, preliminary cooling is performed in the fourth heat exchanger (HX4) 150, and after gas-liquid separation of the first separator (SEP1) 250, the formed gas phase enters the fourth heat exchanger (XH4) 150 to be further cooled to the air state I, and the formed liquid phase is discharged by a liquid phase outlet of the first heat exchanger (HX1) 120.

Embodiment 5

Figure 5:
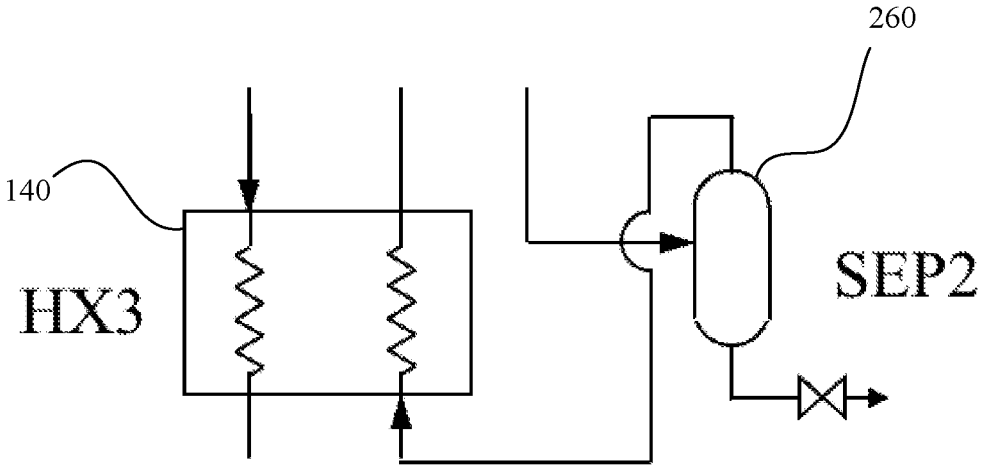
FIG. 5 is a schematic structural view of a fourth heat exchanger HX3 with a second separator SEP1 provided by Embodiment 5 of the present invention.

FIG. 5 is a schematic structural diagram of a third heat exchanger HX3 with a second separator SEP1 provided by Embodiment 5 of the present invention.

Preferably, the air D1 is firstly subjected to gas-solid separation by the second separator (SEP2) 260, then the formed gas phase enters the third heat exchanger (HX3) 140, and is cooled to form the low-moisture content low-temperature air E1, and the formed solid phase water is discharged by a solid phase outlet of the second separator (SEP2) 260.

Preferably, the third heat exchanger (HX3) 140 further includes a cold storage material. The cold storage material includes a phase change cold storage material and a non-phase change cold storage material. The phase change cold storage material is a solid-liquid phase change material having a phase transition temperature of −60° C. to −100° C., and includes at least one of octamethyl trisiloxane, decamethyltetrasiloxane, dodecamethylpentasiloxane, tetradecylhexasiloxane, n-propylcyclohexane, vinyl toluene, butylbenzene, sec-butylbenzene, o-methylisopropylbenzene, p-cymene, hexyl acetate, butyl valerate, perfluorohexane, 2H-perfluoropentane, 3H-perfluoropentane, or perfluoro-2-methyl-3-pentanone. The non-phase change material is stainless steel or aluminum.

The low-temperature quick-freezing freeze-drying system provided by the invention includes: the compressor unit (CU) 110, the first heat exchanger (HX1) 120, the air cooler (AC) 220, the second heat exchanger (HX2) 130, the throttle valve (JT) 210, the third heat exchanger (HX3) 140, the circulating fan (FAN) 240, the drying chamber (DC) 230, the third valve (V3) 180, the fourth valve (V4) 190 and connecting pipelines. The above elements form the refrigeration circulation loop, the quick freezing/freeze-drying circulation loop, and the desorption drying circulation loop, thereby realizing the low-temperature quick-freezing and freeze-drying of materials. The invention adopts the heat exchangers with a cold storage function, so that the refrigeration capacity of the compressor is stored and used intensively to achieve rapid cooling of the materials.

In addition, according to the low-temperature quick-freezing freeze-drying system provided by the present invention, since the air forcible circulation is adopted for freeze-drying, the heat exchange coefficient is large and the drying efficiency is high.

Meanwhile, the low-temperature quick-freezing freeze-drying system provided by the present invention is high in integration level, miniaturized in device, simple in process and efficient and energy-saving.

While the invention has been described in terms of what is presently considered to be the most practical and preferred embodiment, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A low-temperature quick-freezing freeze-drying system, comprising: a refrigeration circulation loop, a quick-freezing/freeze-drying circulation loop, and a desorption drying circulation loop, wherein:

the refrigeration circulation loop comprises a compressor unit, a first heat exchanger, an air cooler, a second heat exchanger, a throttling element, a third heat exchanger, and a connecting pipeline, a high pressure refrigerant outlet of the compressor unit is connected to a refrigerant high pressure inlet of the first heat exchanger, a refrigerant high pressure outlet of the first heat exchanger is connected to an inlet of the air cooler, an outlet of the air cooler is connected to a high pressure refrigerant inlet of the second heat exchanger, a high pressure refrigerant outlet of the second heat exchanger is connected to a refrigerant high pressure inlet of the throttling element, a refrigerant low pressure outlet of the throttling element is connected to a refrigerant inlet of the third heat exchanger, a refrigerant outlet of the third heat exchanger is connected to a refrigerant low pressure inlet of the second heat exchanger, and a refrigerant low pressure outlet of the second heat exchanger is connected to a low pressure inlet of the compressor unit, thereby forming the refrigeration circulation loop;

the quick-freezing/freeze-drying circulation loop comprises a circulating fan, a drying chamber, a third valve, the third heat exchanger, a fourth valve and a connecting pipeline which are connected in sequence, low-temperature low-moisture content air A1 passes by the circulating fan and then forms air B1, humid air C1 is formed by absorbing material moisture in the air B1 in the drying chamber, the humid air C1 passes by the third valve to form air D1, after gas-solid separation, low-moisture content low-temperature air E1 is formed from the cooling in the third heat exchanger, and passes by the fourth valve (V4) to form the low-temperature low-moisture content air A1, thereby completing the quick-freezing/freeze-drying circulation loop;

the desorption drying circulation loop comprises the circulating fan, the drying chamber, a second valve, a fourth heat exchanger, the third heat exchanger, the first heat exchanger, the first valve and a connecting pipeline which are connected in sequence, high-temperature air A2 passes by the circulating fan to form B2, humid air C2 is formed by absorbing bound water in the high-temperature air A2 in the drying chamber, the humid air C2 passes by the second valve, and then completes the gas-water separation from an air state H to an air state I and a cooling process in the fourth heat exchanger to form air D2, then the air D2 passes by the third heat exchanger to form air E2, the air E2 passes by the fourth heat exchanger to form air F, the air F passes by the first heat exchanger to form air G, and the air G passes by the first valve to form the high-temperature air A2, thereby completing the desorption drying circulation loop.

2. The low-temperature quick-freezing freeze-drying system according to claim 1, further comprising a control unit electrically coupled to the first valve, the second valve, the third valve, and the fourth valve, wherein the control unit is configured to control opening and closing of the first valve, the second valve, the third valve and the fourth valve.

3. The low-temperature quick-freezing freeze-drying system according to claim 1, wherein the fourth heat exchanger is further connected to a first separator by a pipeline, in the process from the air state H to the air state I, firstly, preliminary cooling is performed in the fourth heat exchanger, and after gas-liquid separation of the first separator, the formed gas phase enters the fourth heat exchanger to be further cooled to the air state I, and the formed liquid phase is discharged by a liquid phase outlet of the first separator.

4. The low-temperature quick-freezing freeze-drying system according to claim 1, wherein the third heat exchanger is further connected to a second separator S by a pipeline, and the air D1 is firstly subjected to gas-solid separation by the second separator, then the formed gas phase enters the third heat exchanger, and is cooled to form the low-moisture content low-temperature air E1, and the formed solid phase water is discharged by a solid phase outlet of the second separator.

5. The low-temperature quick-freezing freeze-drying system according to claim 1, wherein the third heat exchanger further comprises a cold storage material, and the cold storage material comprises a phase change cold storage material and a non-phase change cold storage material.

6. The low-temperature quick-freezing freeze-drying system according to claim 5, wherein the phase change cold storage material is a solid-liquid phase change material having a phase transition temperature of −60° C. to −100° C., and comprises at least one of octamethyl trisiloxane, decamethyltetrasiloxane, dodecamethylpentasiloxane, tetradecylhexasiloxane, n-propylcyclohexane, vinyl toluene, butylbenzene, sec-butylbenzene, o-methylisopropylbenzene, p-cymene, hexyl acetate, butyl valerate, perfluorohexane, 2H-perfluoropentane, 3H-perfluoropentane, or perfluoro-2-methyl-3-pentanone, and the non-phase change material is stainless steel or aluminum.

7. The low-temperature quick-freezing freeze-drying system according to claim 1, wherein an auxiliary heater is further disposed between the third heat exchanger and the fourth heat exchanger.

* * * * *